US009837743B2

(12) United States Patent
Larkin

(10) Patent No.: US 9,837,743 B2
(45) Date of Patent: Dec. 5, 2017

(54) BANANA PLUG WITH RAISED BREAK POINT

(71) Applicant: Westek Electronics, Inc., Watsonville, CA (US)

(72) Inventor: Kevin B. Larkin, Pebble Beach, CA (US)

(73) Assignee: Westek Electronics, Inc., Watsonville, CA (US)

( * ) Notice: Subject to any disclaimer, the term of this patent is extended or adjusted under 35 U.S.C. 154(b) by 0 days.

(21) Appl. No.: 15/139,235

(22) Filed: Apr. 26, 2016

(65) Prior Publication Data

US 2017/0310030 A1 Oct. 26, 2017

(51) Int. Cl.

| | |
|---|---|
| ***H01R 13/05*** | (2006.01) |
| ***H01R 13/58*** | (2006.01) |
| ***H01R 24/28*** | (2011.01) |
| *H01R 101/00* | (2006.01) |

(52) U.S. Cl.
CPC ..... *H01R 13/052* (2013.01); *H01R 13/5845* (2013.01); *H01R 24/28* (2013.01); *H01R 2101/00* (2013.01)

(58) Field of Classification Search
CPC ..... H01R 13/5833; H01R 13/052
USPC ..... 439/825, 457, 465, 826, 843
See application file for complete search history.

(56) References Cited

U.S. PATENT DOCUMENTS 523,062 A * 7/1894 Winters ..... C03B 9/3875 65/267
2,699,535 A * 1/1955 Flora ..... H01R 13/20 439/735
4,486,068 A * 12/1984 Ghigliotti ..... H01R 13/052 439/825
4,780,097 A 10/1988 Piscitelli
5,004,438 A * 4/1991 Cabourne ..... H01R 13/052 439/825
5,015,195 A * 5/1991 Piriz ..... H01R 13/17 439/272
5,026,301 A * 6/1991 Balyasny ..... H01R 4/2404 29/866

(Continued)

FOREIGN PATENT DOCUMENTS

CN 202050075 U 11/2011

OTHER PUBLICATIONS

International Searching Authority, International Search Report and Written Opinion, PCT/US2017/029480, 12 pages, dated Aug. 3, 2017.

*Primary Examiner* — Tulsidas C Patel
*Assistant Examiner* — Marcus Harcum

(57) ABSTRACT

A banana plug center pin with a raised break point is disclosed. The banana plug center pin comprises a top portion and a bottom portion. The top portion has a first diameter, and the bottom portion has a second diameter. The banana plug center pin with a raised break point further includes a locking ring peripherally surrounding the center pin at the interface of the top portion and the bottom portion. Additionally, the banana plug center pin has a fillet feature coupled to the bottom portion and the locking ring. In one embodiment, the interface of the top portion and the bottom portion is located such that when the center pin is inserted into a banana jack, the interface is disposed above a top edge of the banana jack.

3 Claims, 9 Drawing Sheets

(56) References Cited

U.S. PATENT DOCUMENTS

| | | | | |
|---|---|---|---|---|
| 5,149,280 | A * | 9/1992 | Edgley | H01R 13/5833 439/456 |
| 5,486,123 | A * | 1/1996 | Miyazaki | H01R 13/15 439/825 |
| 5,571,145 | A | 11/1996 | Drebin | |
| 5,695,357 | A * | 12/1997 | Wright | H01R 4/50 29/877 |
| 6,688,922 | B2 * | 2/2004 | Schreier | H01R 13/41 439/606 |
| 7,175,471 | B1 * | 2/2007 | Skluzacek | H01R 24/547 361/119 |
| 7,467,980 | B2 * | 12/2008 | Chiu | H01R 13/18 439/843 |
| 7,766,682 | B1 * | 8/2010 | Larkin | H01R 13/567 439/281 |
| 2011/0111612 | A1 | 5/2011 | Su et al. | |
| 2013/0244506 | A1 * | 9/2013 | Endo | H01R 4/48 439/825 |

* cited by examiner

BANANA PLUG WITH RAISED BREAK POINT

BACKGROUND ART

The banana plug is a commonly used device for making electrical connection with another device. Typically, a device, to which an electrical connection is desired, has a "female" banana jack formed therein. In order to make an electrical connection with the device, a "male" banana plug is inserted into the banana jack. Although banana plugs have existed for many years and are widely used, they are not without drawbacks. As the use of banana plugs becomes ubiquitous, banana plugs are now utilized outside of laboratory environments. Banana plugs are used with mobile testing devices, in harsh environments, are and subject to conditions for which they were not originally intended.

BRIEF DESCRIPTION OF THE DRAWINGS

The accompanying drawings, which are incorporated in and form a part of this specification, illustrate embodiments of the present technology and, together with the description, serve to explain the principles of the present technology. The drawings referred to in this description should not be understood as being drawn to scale except if specifically noted.

PRIOR ART

DESCRIPTION OF EMBODIMENTS

Reference will now be made in detail to various embodiments of the present technology, examples of which are illustrated in the accompanying drawings. While the present technology will be described in conjunction with these embodiments, it will be understood that they are not intended to limit the present technology to these embodiments. On the contrary, the present technology is intended to cover alternatives, modifications and equivalents, which may be included within the spirit and scope of the present technology as defined by the appended claims. Furthermore, in the following description of the present technology, numerous specific details are set forth in order to provide a thorough understanding of the present technology. In other instances, well-known methods, procedures, components, and circuits have not been described in detail as not to unnecessarily obscure aspects of the present technology.

Overview

Embodiments in accordance with the present invention describe banana plug center pin with a raised break point. Embodiments in accordance with the present invention also describe a banana plug which includes the above described center pin such that the banana plug has a raised break point. As will be described below in detail, the raised break point ensures that should the banana plug break while inserted into a banana jack, the break point will be above the top edge of the banana jack. As such, the broken portion of the banana plug, residing in the banana jack, can be easily removed. Various embodiments of the present invention also describe novel features for improving the reliability of a banana plug.

DETAILED DESCRIPTION

Figure 1:
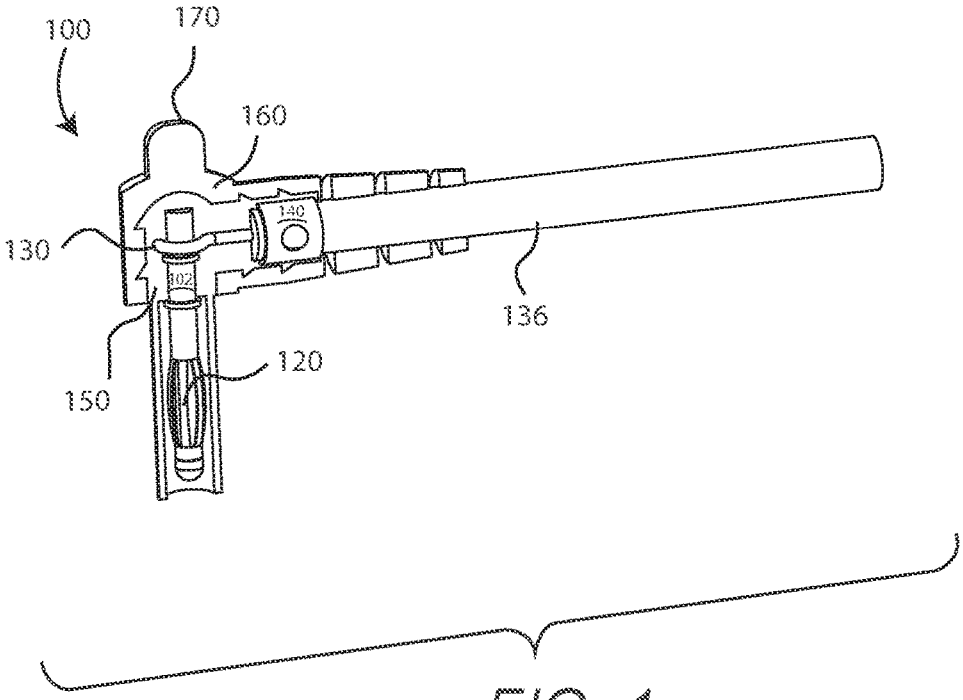
FIG. 1 shows a cut away perspective view of one embodiment of a banana plug with a raised break point in accordance with the present claimed invention.
Figure 2:
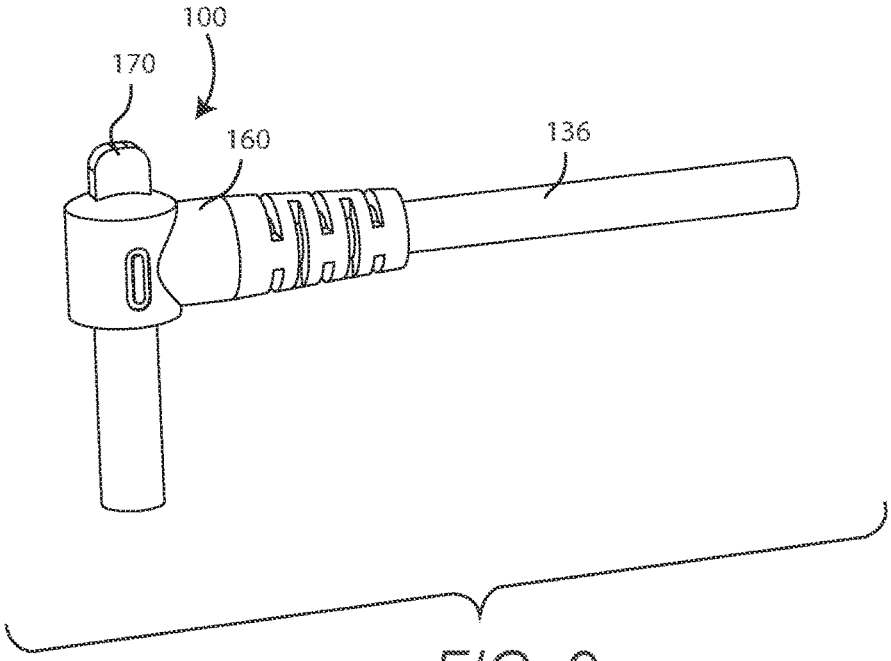
FIG. 2 shows a perspective view of a banana plug with a raised break point in accordance with one embodiment of the present claimed invention.

Referring now to FIG. 1, a cut away perspective view of one embodiment of a banana plug with a raised break point 100 in accordance with the present claimed invention is shown. Banana plug with raised break point 100 is comprised of various components. The present description will first briefly identify the various components, and then each of the components will be described below in detail. Banana plug with raised break point 100 includes a center pin 102. As shown in FIG. 1, banana plug with raised break point 100 also includes a spring contact 120 which peripherally surrounds at least some of the bottom portion of center pin 102. Banana plug with raised break point 100 also includes a cable conductor 130. Cable conductor 130 has a first end electrically coupled to center pin 102, and a second end extending into a cable jacket 136. Banana plug with raised break point 100 further includes a crimped strain relief 140 having openings formed therein. As will be described below, in one embodiment, crimped strain relief 140 is compressed about cable jacket 136 such that cable jacket 136 bulges at least partially through the openings in crimped strain relief 140. In one embodiment, banana plug with raised break point 100 also includes an inner component 150. Inner component 150 encapsulates, in one embodiment, crimped strain relief 140, cable conductor 130, and a portion of center pin 102. Referring still to FIG. 1, banana plug with raised break point 100 is at least partially encapsulated in an outer housing 150. Finally, in one embodiment a pull tab 170 is coupled to outer housing 170. Pull tab 170 provides a gripping portion for a user to, for example, extract banana plug with raised break point 100 from a banana jack, not shown. Referring briefly to FIG. 2, a perspective view of banana plug with raised break point 100 is provided. For purposes of clarity, FIG. 2 shows banana plug with raised break point 100 without the cut away view details shown in FIG. 1.

Figure 3:
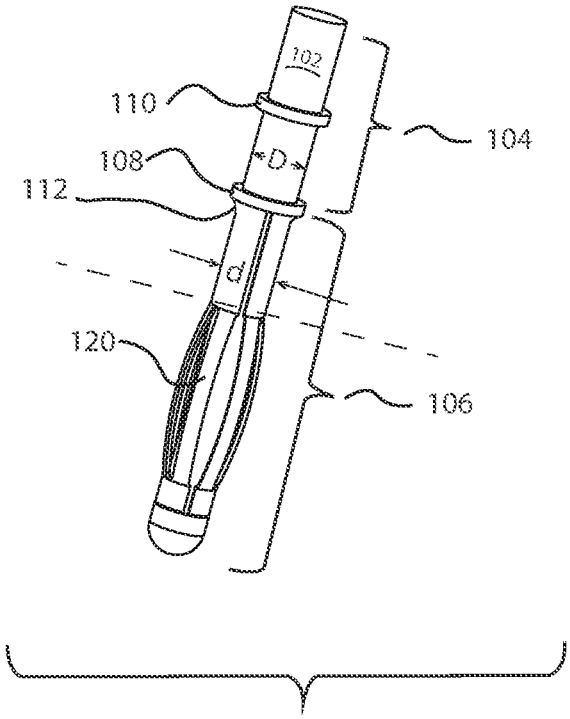
FIG. 3 shows a partial cut away view of a center pin with a raised break point in accordance with one embodiment of the present claimed invention.

Referring now to FIG. 3, a partial cut away view of center pin with a raised break point 102 in accordance with one embodiment of the present invention is shown. Importantly, and as will be described below, center pin 102 has a raised break point. That is, center pin 102 has a break point which is raised with respect to the break point associated with conventional center pins. As shown in FIG. 3, center pin 102 includes a top portion 104 and a bottom portion 106. In the present embodiment, top portion 104 of center pin 102 has a diameter, D. Further, in the present embodiment, bottom portion 106 of center pin 102 has a diameter, d. In the present embodiment diameter D is greater than diameter d. The significance of the difference in diameters D and d will be discussed below in detail. Center pin having raised break point 102 further includes a locking ring 108. In the present embodiment, locking ring 108 peripherally surrounds center pin 102 and is located at the interface of top portion 104 and bottom portion 106. In various embodiments, center pin 102 may also include additional locking rings, such as, for example, locking ring 110. Although, one additional locking ring 110 is shown in the present embodiment, the present invention is also well suited to embodiments in which center pin 102 includes more than one additional locking ring.

Referring still to FIG. 3, in the present embodiment, center pin 102 also includes a fillet feature 112. As shown in FIG. 3, fillet feature 112 is coupled to bottom portion 106 and to locking ring 108 of center pin 102. In one embodiment, fillet feature 112 is, for example a tapered bevel.

Figure 4:
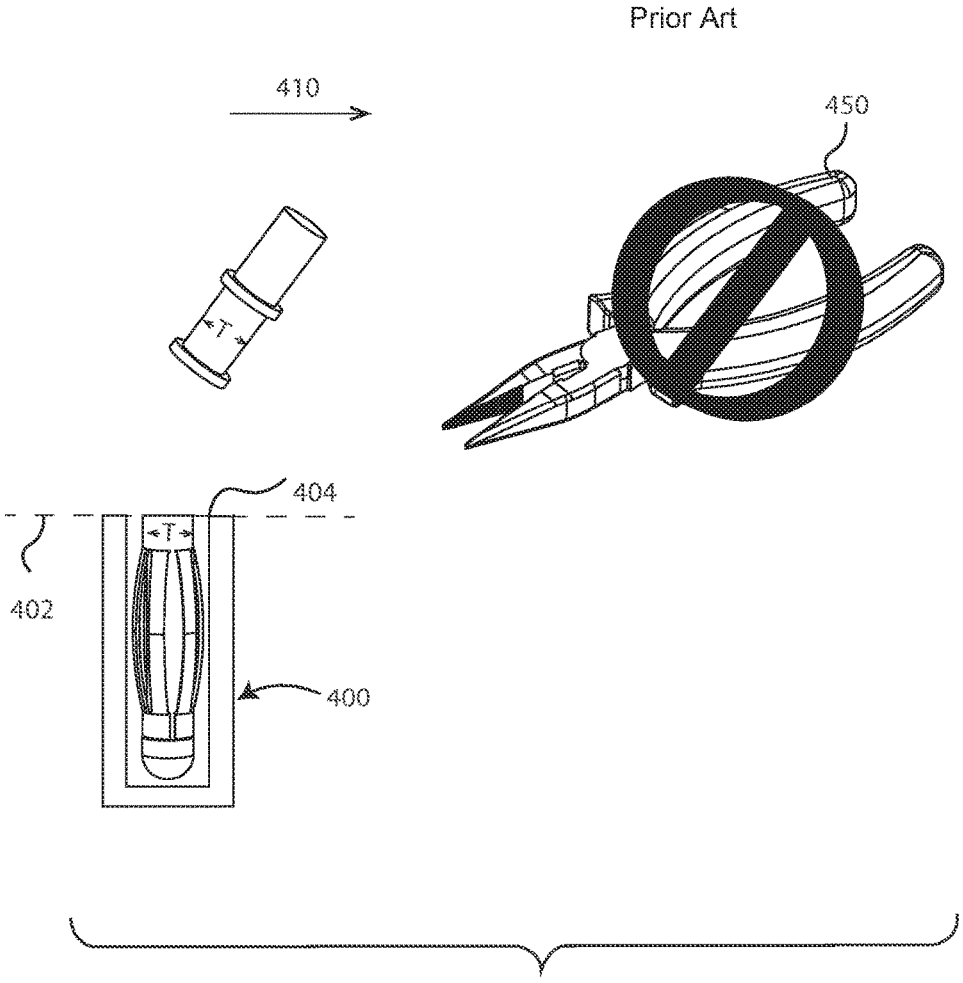
FIG. 4 shows a side view of a conventional center pin breaking off in a banana jack with a lowered break point.

Referring now to Prior Art FIG. 4, a side view of a conventional center pin is shown inserted into a banana jack 400. It should be noted that in Prior Art FIG. 4, various components of a banana plug are not shown for clarity. In Prior Art FIG. 4, it will be noted that banana jack 400 has a top surface denoted by dotted line 402. During use, it is common for users to remove a banana plug from the banana jack into which it is inserted (e.g. banana jack 400), by pulling, for example, on the cord of the banana plug. In other instances, a user may simply pull the banana plug out of banana jack 400 at an angle, rather than pulling straight upward on the banana plug. For example, a user may pull on the banana plug at an angle as indicated by arrow 410. When this occurs, the center pin of the banana plug is forced against the upper edge 404 of banana jack 400. It should further be noted that conventional center pins have a uniform thickness T, along the entire length of the center pin. In conventional banana plugs, this causes the conventional center pin to break or snap off along line 402 of FIG. 4. When the conventional center pin breaks along line 402 as shown in Prior Art FIG. 4, it is often not possible for the user to extract the broken portion of the conventional center pin from banana jack 400. This inability to extract the broken piece of the conventional center pin is depicted by the needle nose pliers 450 in the circle with a slash. In practice, the inability to remove broken portions of conventional center pins can result in downtime or servicing of a very expensive piece of equipment, merely to remove a portion of the conventional center pin.

Figure 5:
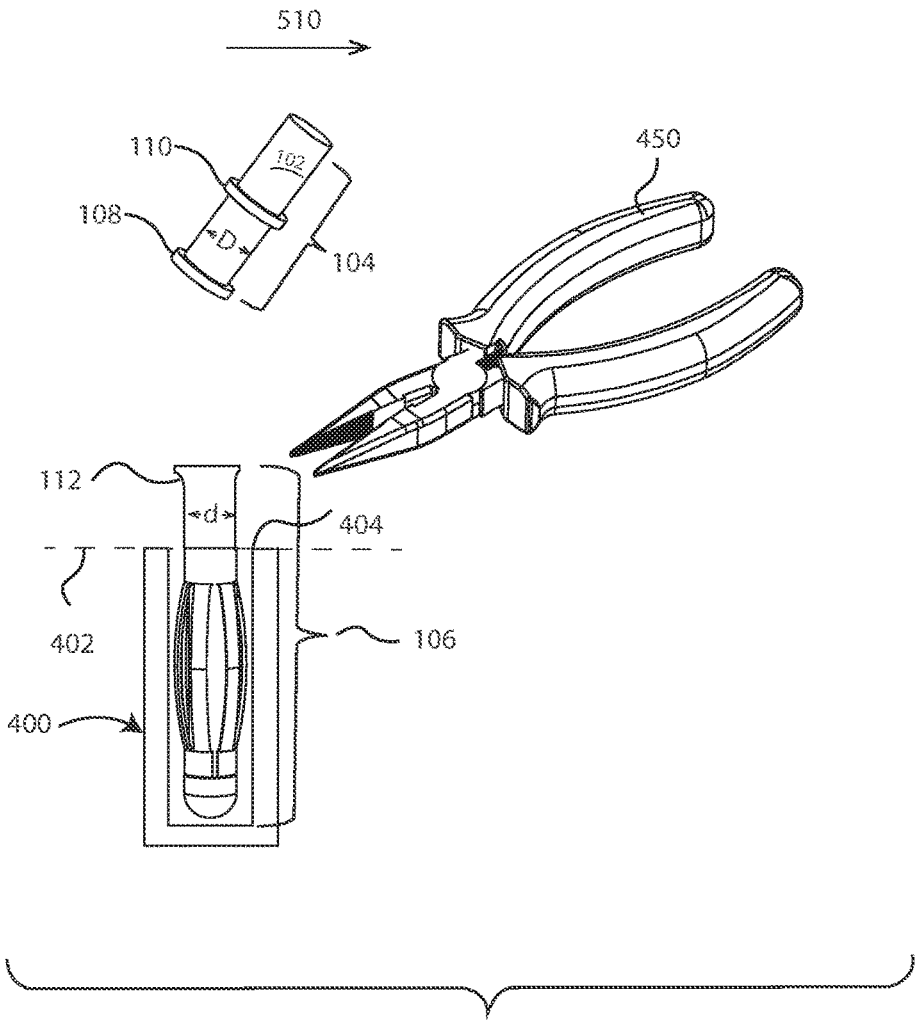
FIG. 5 shows a side view of a center pin with a raised break point breaking off in a banana jack in accordance with one embodiment of the present claimed invention.

Referring now to FIG. 5, a side view of a center pin 102 with a raised break point is shown inserted into a banana jack 400 in accordance with an embodiment of the present invention. With respect to FIG. 5, the present discussion will now describe, in detail, the beneficial raised break point of center pin 102 of the present invention. That is, the following discussion will describe how center pin 102 has a break point which is raised with respect to the break point associated with conventional center pins. It should be noted that in FIG. 5, various components of banana plug 100 are not shown for clarity. In FIG. 5, it will be noted that banana jack 400 has a top surface denoted by dotted line 402. As mentioned above, during use, it is common for users to remove a banana plug from the banana jack into which it is inserted (e.g. banana jack 400), by pulling, for example, on cable jacket 136 of banana plug 100. In other instances, a user may simply pull banana plug 100 out of banana jack 400 at an angle, rather than pulling straight upward on the banana plug. For example, a user may pull on the banana plug at an angle as indicated by arrow 510. When this occurs, center pin 102 of banana plug 100 is forced against the upper edge 404 of banana jack 400.

Referring still to FIG. 5, it should further be noted that center pin 102 of the present embodiment has a diameter, D, along top portion 104, and a smaller diameter, d, along bottom portion 106. In the present embodiment, the reduced diameter, d, of bottom portion 106, allows center pin 102 to bend more freely than is found in a conventional center pin with a larger diameter. Further, by adding a fillet feature 112 which couples bottom portion 106 and locking ring 108, forces (due to the angled (510) extraction of banana plug 100) are distributed along bottom portion 106. That is, in the present embodiment, the reduced diameter of bottom portion 106 in combination with the addition of fillet feature 112 distributes extraction forces along bottom portion 108. Also, the bending of center pin 102 (due to the reduced diameter of bottom portion 106) helps to reduce the accumulation of forces on center pin 102 along line 402. Thus, rather than concentrating forces along line 402, center pin 102 of the present embodiments allows extraction forces to be distributed along the length of bottom portion 106 and spread to the interface of top portion 104 and bottom portion 106. As a result, should the forces exceed the breaking point of center pin 102, in the present embodiments, center pin 102 will break at the interface of top portion 104 and bottom portion 106. Hence, in the present embodiments, if center pin 102 breaks, it will do so above line 402 as shown in FIG. 5. As a result, it is easy for the user to extract the broken portion of center pin 102 from banana jack 400. This ability to extract the broken piece of center pin 102 is depicted by the needle nose pliers 450 of FIG. 5. Hence, embodiments in accordance with the present invention eliminate significant expensive downtime and repairs associated with the use of conventional banana plugs.

Figure 6:
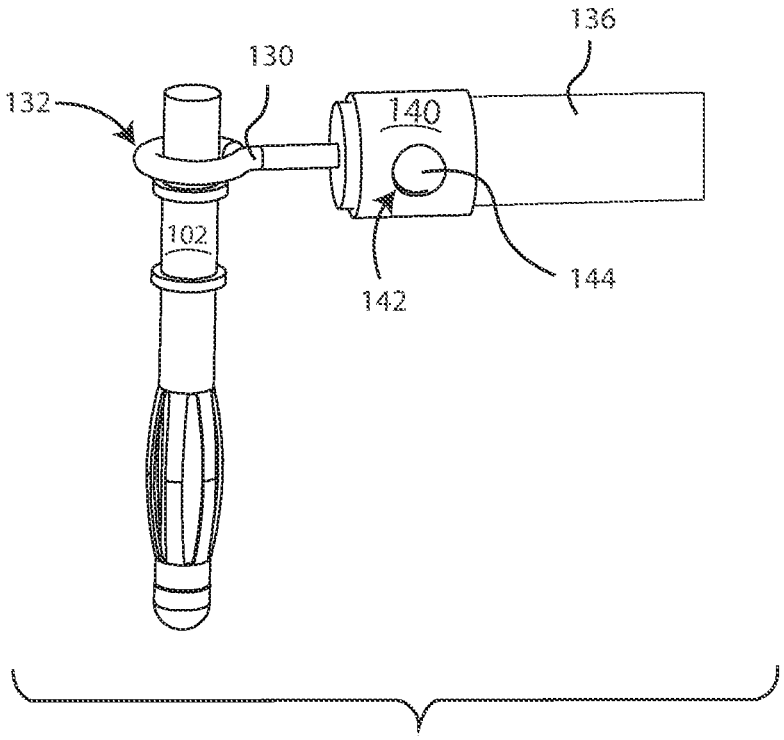
FIG. 6 shows a perspective view of a center pin having a cable conductor coupled thereto in accordance with the present claimed invention.

Embodiments in accordance with the present invention realize additional structural integrity for banana plug 100, of FIG. 1, through several novel mechanisms. For example, referring now to FIG. 6, a perspective view is shown of center pin 102 having cable conductor 130 coupled thereto. In the embodiment of FIG. 6, cable conductor has a first end 132 electrically coupled to center pin 102, and a second end, hidden, extending into a cable jacket 136. In the present embodiment, banana plug with raised break point 100 further includes a crimped strain relief 140 having openings typically shown as 142 formed therein. In one embodiment, crimped strain relief 140 is compressed about cable jacket 136 with sufficient force such that a portion of cable jacket 136 bulges at least partially through openings 142 in crimped strain relief 140. As a result, a bump 144 of cable jacket 136 is created. Bump 144 of cable jacket 136 provides an additional adhesion point for the inner component, not shown in FIG. 6.

Figure 7A:
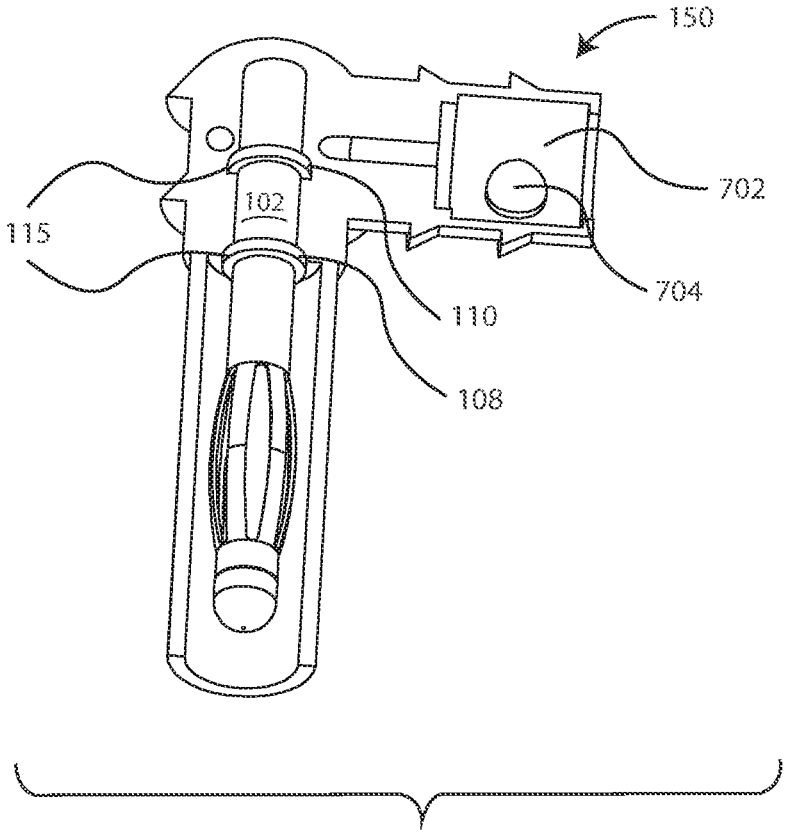
FIGS. 7A-7B are cut away views of an inner component in accordance with the present claimed invention.

Referring now to FIG. 7A, a cut away view of inner component 150 is shown. In FIG. 7A, center pin 102 is shown disposed within inner component 150. FIG. 7A clearly shows a recessed region 702 for receiving cable conductor 130, including first end 132. Additionally, recessed region 702 of inner component 150 is formed to receive cable jacket 136 and crimped strain relief 140. Inner component 150 further has an indent 704 for receiving bump 144 of cable conductor 136. Importantly, various features on center pin 102 prevent movement of center pin 102 with respect to inner component 150. Specifically, locking features 108 and 110 provide numerous hard chine points to ensure that center pin 102 does not move with respect to inner component 150. In addition, in various embodiments, locking features 108 and 110 have a "flat" (typically shown as 115) or non-curved surface formed thereon. Flat 115 helps to prevent rotational movement of center pin 102 with respect to inner component 150. As a result, embodiments in accordance with the present invention include features to prevent motion in all directions with respect to inner component 150.

Figure 7B:
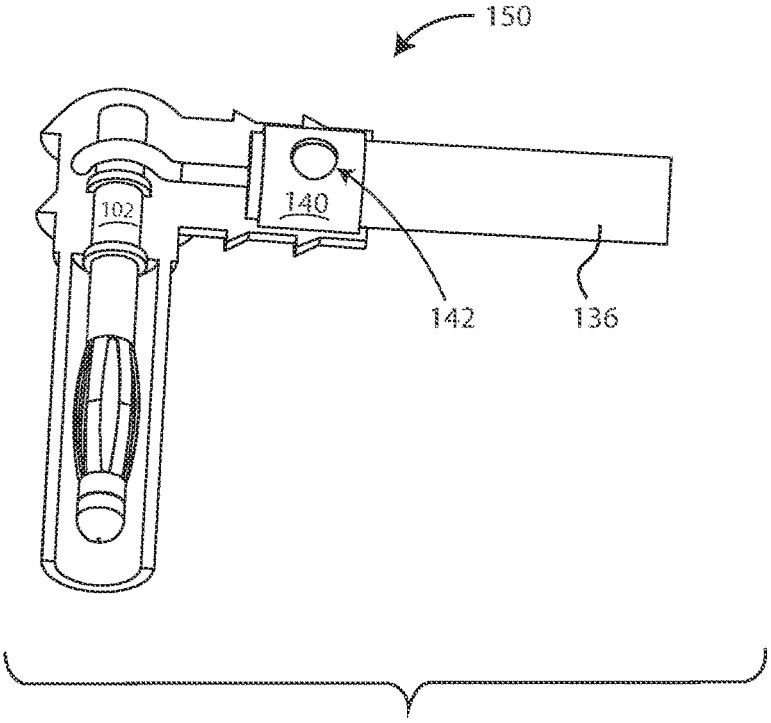

FIG. 7B provides a cut away view of inner component 150 with cable jacket 136 and crimped strain relief 140 (with bump 144) disposed in recessed 702. Inner component 150 provides several significant advantages to banana plug 100 of the present embodiments. First, in various embodiments, inner component 150 prevents movement of various elements or components with respect to outer housing 160. That is, as depicted in FIGS. 7A and 7B, inner component 150 encapsulates components such as for example center pin 102. In various embodiments, inner component 150 is made of a material having a hardness which is greater than that of outer housing 160. By encapsulating the components with a harder material than that of outer housing 160, inner component 150 increases the rigidity of banana plug 100. See FIG. 8, in which a perspective view is shown of inner component 150. Once inner component 150 is encapsulated by outer housing 160, a rigid banana plug is achieved. The ruggedized nature of the present banana plug 100 further prevents bending of center pin 102 during use of banana plug 102.

Figure 8:
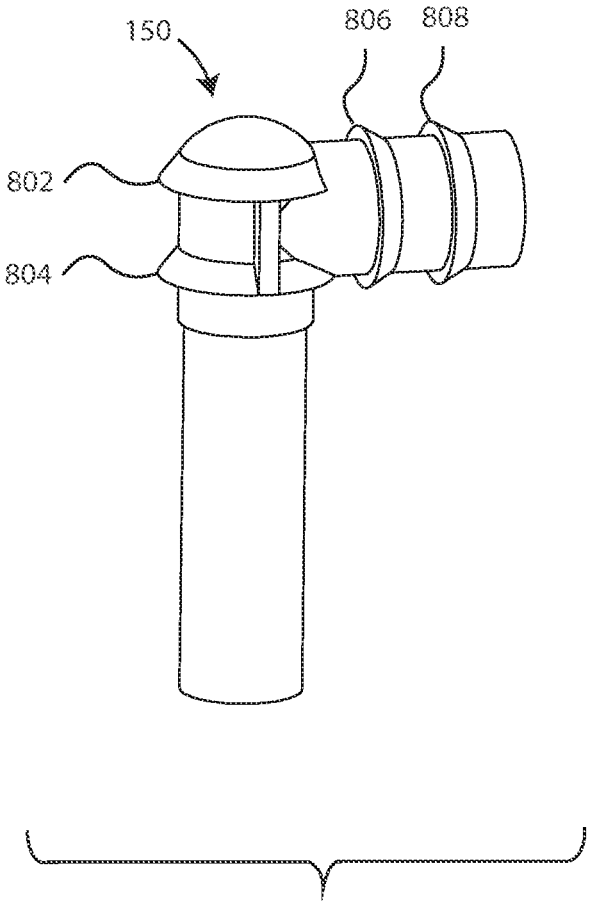
FIG. 8 is a perspective view of an inner component in accordance with the present claimed invention.

Referring to FIG. 8, in various embodiments, inner component 150 also includes protrusions 802, 804, 806, and 808. Protrusions 802 and 804 are configured to prevent vertical (i.e. up and down) movement of inner component 150 with respect to outer housing 160 of FIG. 1. Similarly, protrusions 806 and 808 are configured to prevent horizontal movement of inner component 150 with respect to outer housing 160. As a result, in various embodiments, the retention of components within inner component 150, coupled with the restriction of movement of inner component 150 with respect to outer housing 160, ensures that banana plug 100 achieves a rigidity not found in conventional banana plugs.

Further, embodiments in accordance with the present invention are well suited to use in numerous environments and present embodiments are not limited to any one single application.

Although the subject matter is described in a language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A banana plug with a raised break point, said banana plug comprising:

a center pin with a raised break point, said center pin comprising:

a top portion, said top portion having a first diameter;

a bottom portion, said bottom portion having a second diameter, said second diameter smaller than said first diameter;

a locking ring peripherally surrounding said center pin at an interface of said top portion and said bottom portion, said locking ring having a flat formed on a surface thereof, and wherein said interface of said top portion and said bottom portion is located such that said interface is disposed above a top edge of a banana jack when said banana plug is inserted into said banana jack; and a fillet feature coupled to said bottom portion and said locking ring, said locking ring, said flat, and said fillet feature configured to prevent movement of said center pin with respect to overlying material;

a spring contact coupled to said center pin, said spring contact peripherally surrounding at least some of said bottom portion of said center pin;

a cable conductor having a first end electrically coupled to said center pin, and a second end extending into a cable jacket;

a crimped strain relief having openings formed therein, said crimped strain relief compressed about said cable jacket such that said cable jacket bulges at least partially through said openings;

an outer housing at least partially encapsulating said cable jacket, said cable conductor, and at least some of said top portion of said center pin; and an inner component disposed at least partially between said outer housing and said center pin, said inner component having protrusions extending there from, said protrusions configured to prevent movement of said inner component with respect to said outer housing, said inner component comprised of a material having a greater hardness than material comprising said outer housing.

2. The banana plug with a raised break point of claim 1, further comprising:

a second locking ring peripherally surrounding said center pin, said second locking ring disposed above said interface of said top portion and said bottom portion.

3. The banana plug with a raised break point of claim 1, further comprising:

a pull tab coupled to said outer housing.

* * * * *